US008479634B2

(12) United States Patent
Nemec

(10) Patent No.: US 8,479,634 B2
(45) Date of Patent: Jul. 9, 2013

(54) TRUNNION NOSE GUARD

(76) Inventor: William J. Nemec, Pittsburgh, PA (US)

( * ) Notice: Subject to any disclaimer, the term of this patent is extended or adjusted under 35 U.S.C. 154(b) by 203 days.

(21) Appl. No.: 13/160,868

(22) Filed: Jun. 15, 2011

(65) Prior Publication Data

US 2012/0137868 A1 Jun. 7, 2012

Related U.S. Application Data

(60) Provisional application No. 61/355,281, filed on Jun. 16, 2010.

(51) Int. Cl.
*F41A 25/00* (2006.01)

(52) U.S. Cl.
USPC ..... 89/37.07; 89/1.1

(58) Field of Classification Search
USPC ..... 89/37.07, 37.03, 14.2; 42/75.02, 42/75.04, 96
See application file for complete search history.

(56) References Cited

U.S. PATENT DOCUMENTS

| | | | | |
|---|---|---|---|---|
| 6,250,197 | B1 * | 6/2001 | Sanderson | 89/37.16 |
| 6,286,411 | B1 * | 9/2001 | Sanderson | 89/37.16 |
| 6,718,862 | B1 * | 4/2004 | Sanderson | 89/37.22 |
| 6,789,455 | B1 * | 9/2004 | Sanderson | 89/37.07 |
| 6,802,238 | B1 * | 10/2004 | Sanderson | 89/37.16 |
| 6,802,239 | B1 * | 10/2004 | Sanderson | 89/41.21 |
| 6,820,532 | B2 * | 11/2004 | Sanderson | 89/41.18 |
| 7,210,391 | B2 * | 5/2007 | Beckmann | 89/37.03 |
| 7,669,359 | B2 * | 3/2010 | Kim | 42/124 |
| 7,908,784 | B2 * | 3/2011 | Kim | 42/146 |
| 2004/0060428 | A1 * | 4/2004 | Sanderson | 89/37.22 |
| 2004/0074382 | A1 * | 4/2004 | Sanderson | 89/37.22 |
| 2006/0048642 | A1 * | 3/2006 | Beckmann | 89/37.03 |
| 2006/0288626 | A1 * | 12/2006 | Kim | 42/73 |
| 2010/0154276 | A1 * | 6/2010 | Kim | 42/90 |
| 2010/0154280 | A1 * | 6/2010 | LaFrance et al. | 42/124 |
| 2012/0117847 | A1 * | 5/2012 | Evans-Hendrick | 42/90 |

* cited by examiner

*Primary Examiner* — Michael Carone
*Assistant Examiner* — Jonathan C Weber
(74) *Attorney, Agent, or Firm* — Thomas Lizzi; IP & International Law North, LLC

(57) ABSTRACT

A trunnion nose guard is a flanged cylinder having internal threads which allow it to thread onto the outer threads of the trunnion nose of a Browning .50 caliber machine gun. The flange of the trunnion nose guard has a face adapted to fit against the front face of the trunnion or against a shim that is interposed between the trunnion front face and the flange. The flange also has at least one hole for receiving a spring-biased locking pin that may be provided on the trunnion front face. The axial length of the trunnion nose guard is selected so that, in use, the trunnion nose guard protects all of the threads of the trunnion nose, but does not extend substantially beyond the end of the trunnion nose.

6 Claims, 10 Drawing Sheets

TRUNNION NOSE GUARD

CROSS-REFERENCE TO RELATED APPLICATIONS

The present application claims the priority of provisional application Ser. No. 61/355,281, which was filed Jun. 16, 2010, and is incorporated herein by reference in its entirety.

FIELD OF THE INVENTION

The present invention relates a trunnion nose guard for a Browning .50 caliber machine gun.

BACKGROUND OF THE INVENTION

There are several models of Browning .50 caliber machine guns. Among these are the models M2HB, M3HB, M3HB flexible, M3, and M3M. An example of the M2HB model machine gun 2 is shown in FIG. 1.

The various M2 and M3 models include a trunnion 4 in the front of the receiver 6 of the machine gun 8 (see FIGS. 2A and 2B). Referring to FIGS. 3 and 4, there is shown a trunnion 4. The trunnion 4 has a large pintle receiving hole, e.g., hole 10, on each of its side faces, e.g. face 12. Referring to FIG. 4, these receiving holes are for receiving a pintle 14 for moveably securing the machine gun 8 to the cradle of a gun support 16. Referring again to FIG. 3, the trunnion 4 has a cylindrical nose 18 which is both internally and externally threaded at its distal end 20. These threads are provided for connecting a barrel support to the receiver for axially supporting the barrel of the machine gun. FIG. 4 shows an example of a large diameter barrel support 22 that is threaded onto the outer threads of the trunnion 4. FIG. 5 shows an example of a small diameter barrel support 24 that is threaded onto the inner threads of the trunnion 4.

The various M3 models are used primarily on helicopters and gunships. For this purpose they are often provided with a trunnion adapter that fits onto the nose of the trunnion which permits them to fit into the cradles of the gun supports which are provided in such vehicles. The trunnion adapters are used because the pintle receiving holes of the trunnion are ill-positioned to receive the pintles of the gun supports of helicopters and gunships. FIGS. 6A and 6B show, respectively, front and side views of such a trunnion adapter 26. The trunnion adapter 26 is internally threaded to thread onto the outer threads of the trunnion nose 18 (see, e.g., FIG. 3). The trunnion adapter 26 also has and a yoke 28 having pintle receiving holes 30, 32 for receiving the pintle of a gun support. The trunnion adapter 26 is used in conjunction with a small diameter barrel support, e.g. barrel support 24 (see FIG. 5).

Such trunnion adapters have been in use for over half a century. The problem with the trunnion adapters that has persisted all this time is that they prevent the guns on which they are used from being mounted on many types of gun supports because their yoke sections interfere with structural members of the gun supports. Although the trunnion adapters may be removed from these guns to permit use of the gun on the gun supports by way of the pintle receiving holes of the trunnion, this solution has its drawbacks in that it leaves the outer threads of the trunnion nose exposed to damaging impacts which could render them unusable. Once they are unusable, the machine gun is no longer capable of receiving a heavy barrel support or of receiving a trunnion adapter.

SUMMARY OF THE INVENTION

The present invention overcomes this long-standing problem by providing a trunnion nose guard that is adapted to fit onto the trunnion nose of a Browning .50 caliber machine gun. The trunnion nose guard is a flanged cylinder having internal threads which allow it to thread onto the outer threads of the trunnion nose. The flange of the trunnion nose guard has a face adapted to fit against the front face of the trunnion or against a shim that is interposed between the trunnion front face and the flange. The outer periphery of the flange face does not extend axially beyond the outer periphery of the trunnion front face. The flange also has at least one hole for receiving a spring-biased locking pin that may be provided on the trunnion face. Preferably, the flange has two such holes, located 180 degrees apart along an imaginary circle which intersects both holes. Also preferably, each hole is elongated on the flange face side of the hole to accommodate some misplacement during manufacturing of a spring-biased locking pin from its standard location on the trunnion front face. The side of the hole opposite the flange face may be smaller as its main purpose is to provide access to depress the locking pin as the trunnion nose guard is screwed onto or off of the trunnion nose. The axial length of the trunnion nose guard is selected so that, in use, the trunnion nose guard protects all of the threads of the trunnion nose, but does not extend substantially beyond the end of the trunnion nose. The trunnion nose guard may be made of any material deemed suitable for the purpose of protecting the trunnion nose threads by a person skilled in the art, but preferably the trunnion nose guard is made of steel, most preferably 4130 or 4140 grade steel.

BRIEF DESCRIPTION OF THE DRAWINGS

The criticality of the features and merits of the present invention will be better understood by reference to the attached drawings. It is to be understood, however, that the drawings are designed for the purpose of illustration only and not as a definition of the limits of the present invention.

DESCRIPTION OF PREFERRED EMBODIMENTS

In this section, some preferred embodiments of the present invention are described in detail sufficient for one skilled in the art to practice the present invention. It is to be understood, however, that the fact that a limited number of preferred embodiments are described herein does not in any way limit the scope of the present invention as set forth in the claims.

Figure 1:
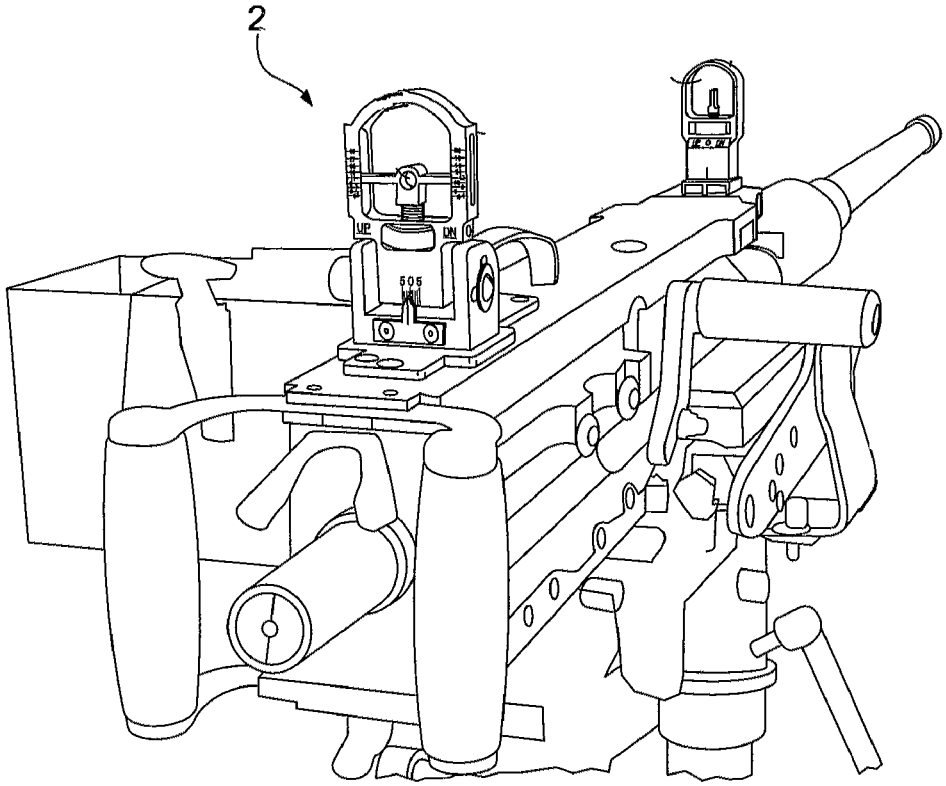
Fig. 1 (Prior Art)
FIG. 1 is a perspective drawing of a prior art M2HB model machine gun mounted on a MK 93 gun support cradle.
Figure 2A:
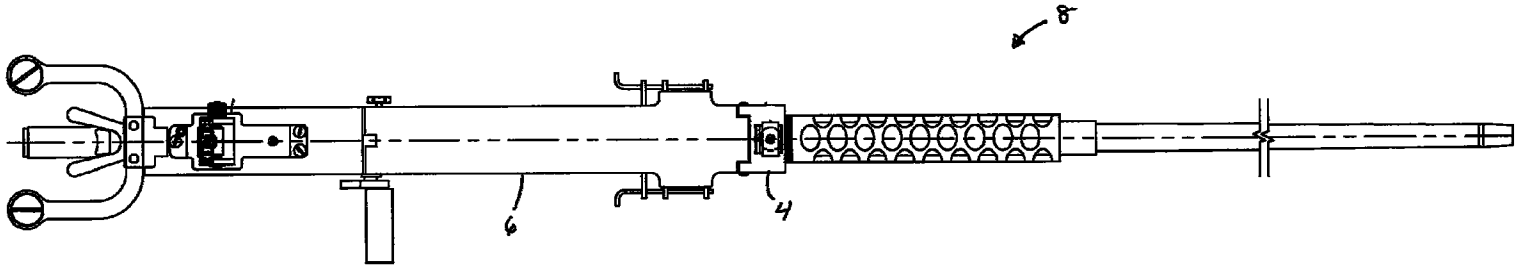
FIG. 2A (Prior Art)
FIGS. 2A and 2B are, respectively, top and side views of a prior art M2HB .50 caliber machine gun.
Figure 2B:
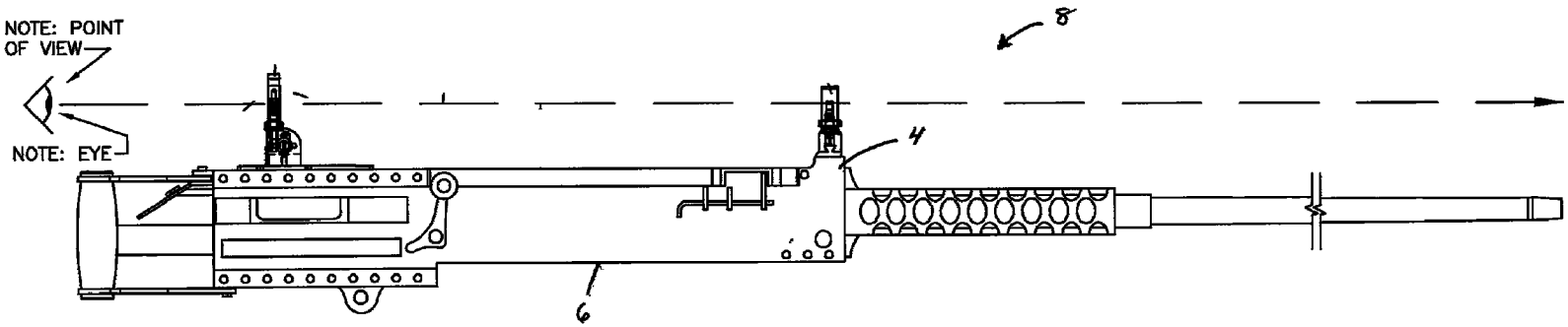
FIG. 2B (Prior Art)
Figure 3:
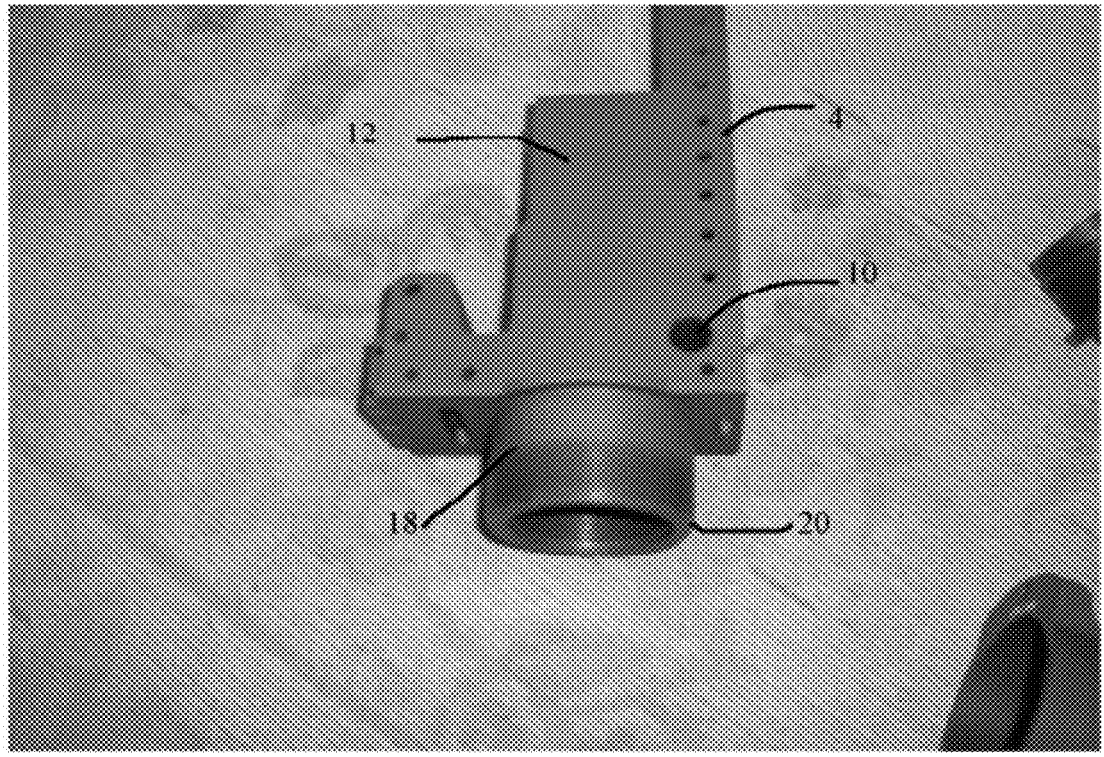
FIG. 3 (Prior Art)
FIG. 3 is perspective view showing the front and side of a prior art trunnion.
Figure 4:
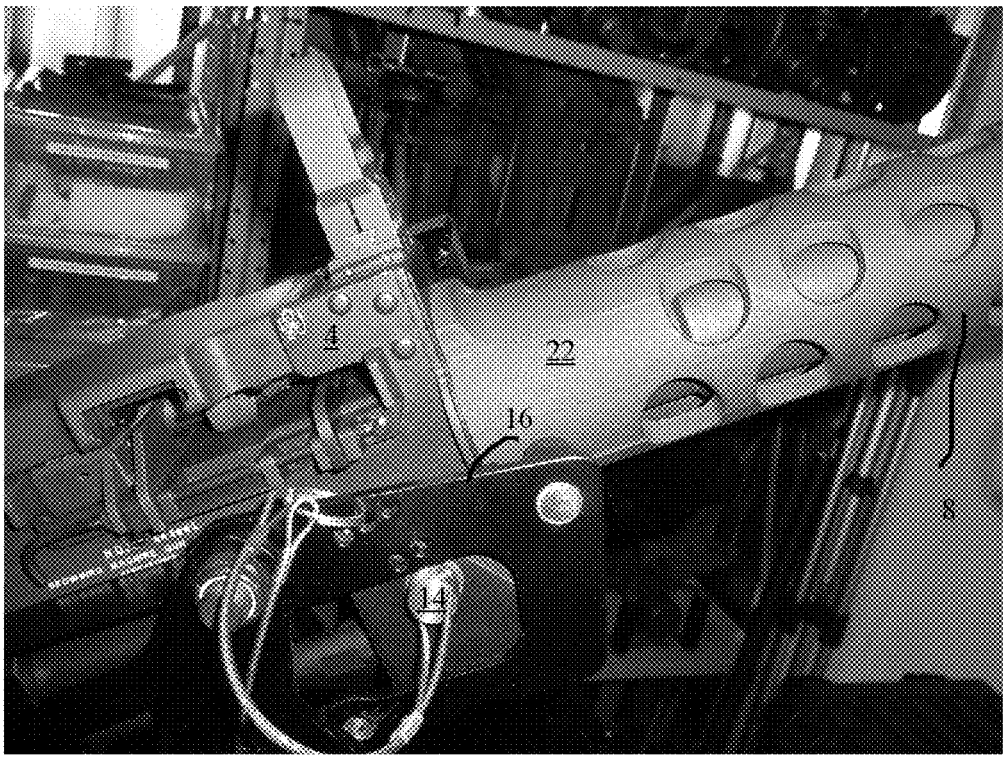
FIG. 4 (Prior Art)
FIG. 4 is a perspective view of the side of a prior art M2HB .50 caliber machine gun mounted on gun support cradle.
Figure 5:
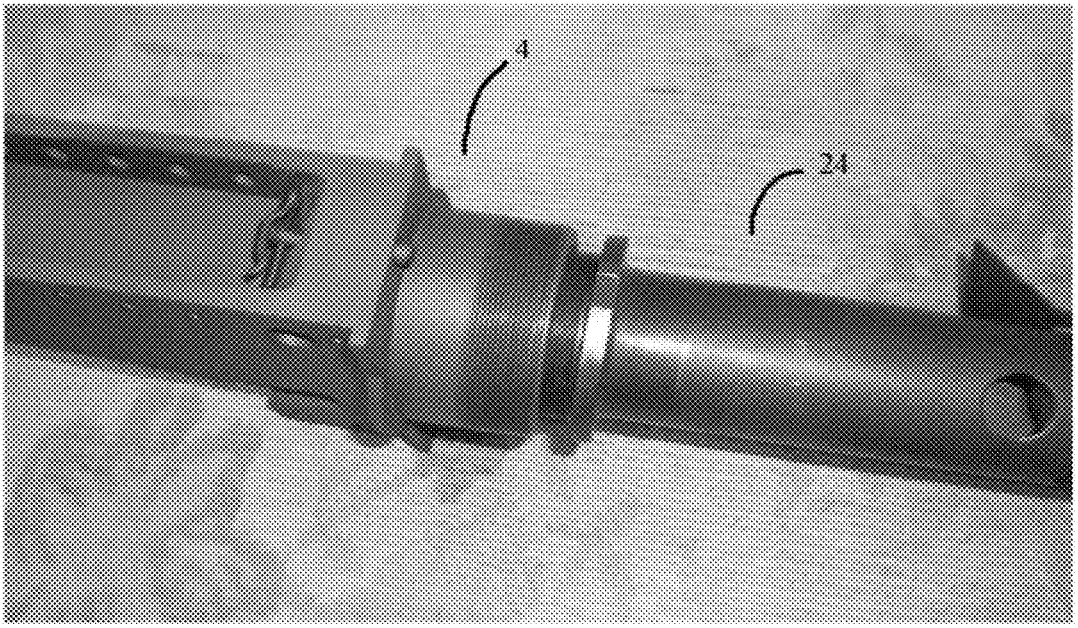
FIG. 5 (Prior Art)
FIG. 5 is a perspective view showing a prior art small barrel support partly screwed into the nose of a trunnion.
Figure 6A:
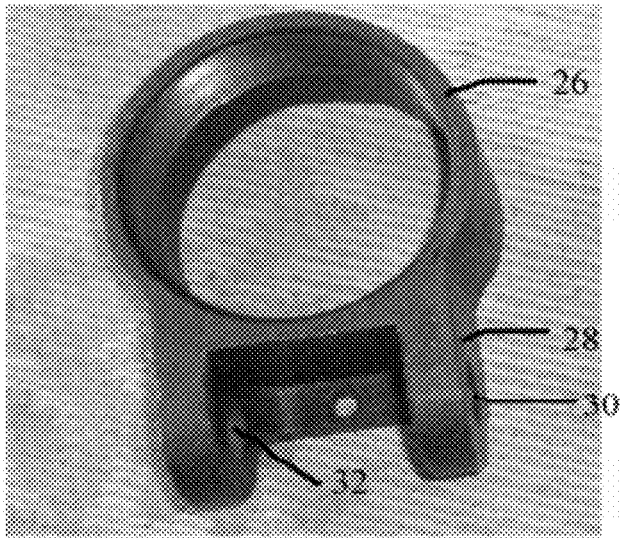
FIG. 6A (Prior Art)
FIGS. 6A and 6B show, respectively, perspective front and side views of a prior art trunnion adapter.
Figure 6B:
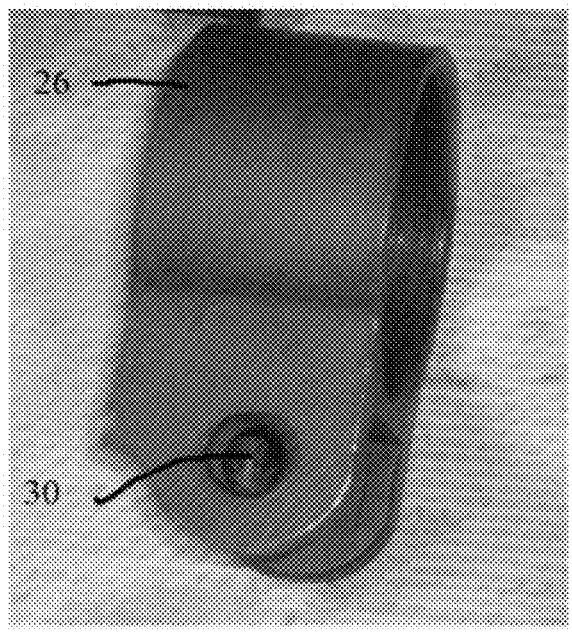
FIG. 6B (Prior Art)
Figure 7A:
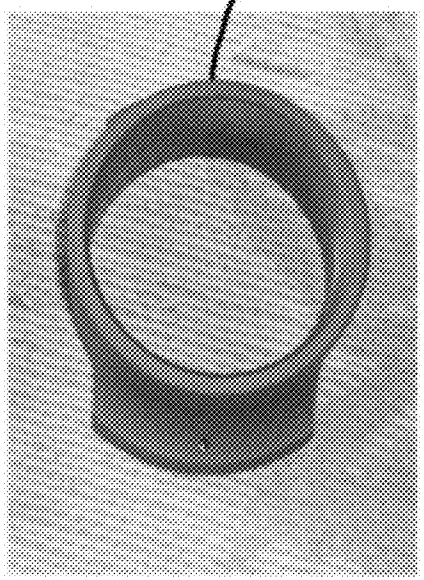
FIGS. 7A, 7B, and 7C, show, respectively, perspective front, side, and rear views of a trunnion nose guard in accordance with an embodiment of the present invention.
Figure 7B:
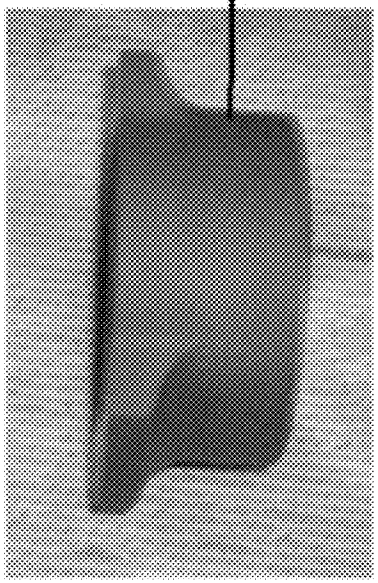
Figure 7C:
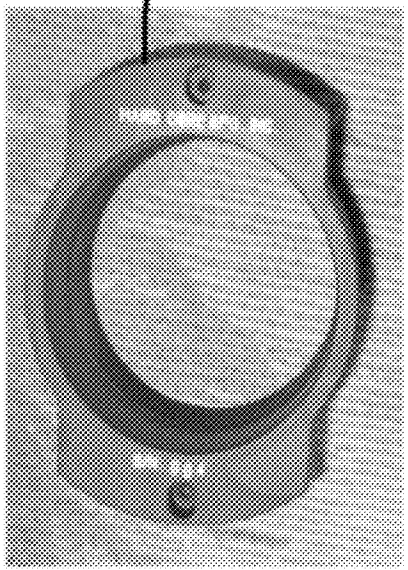
Figure 9:
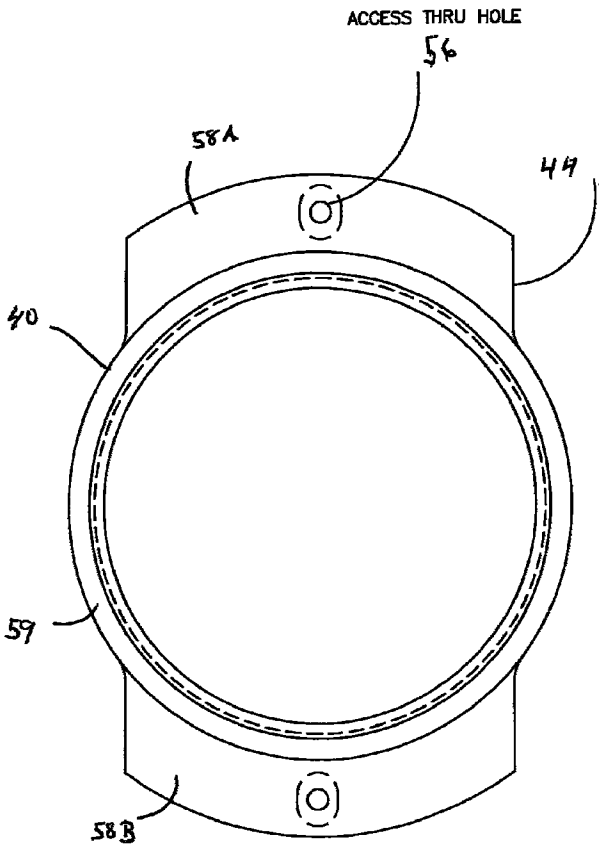
FIG. 9 is a plan view, partly in cross-section, showing the front of the trunnion nose guard of FIG. 8.
Figure 8:
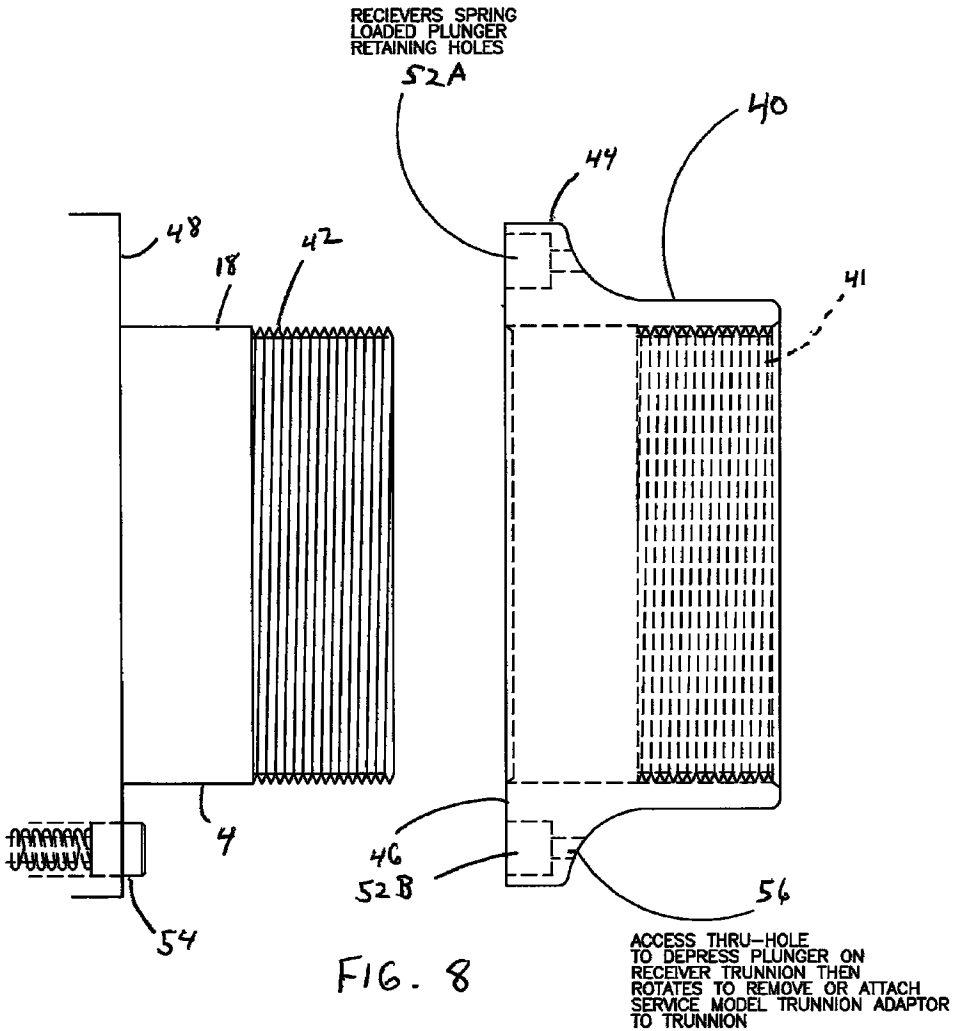
FIG. 8 is a side view, partly in cross-section, showing a trunnion nose and a trunnion nose guard in accordance with an embodiment of the present invention.
Figure 10:
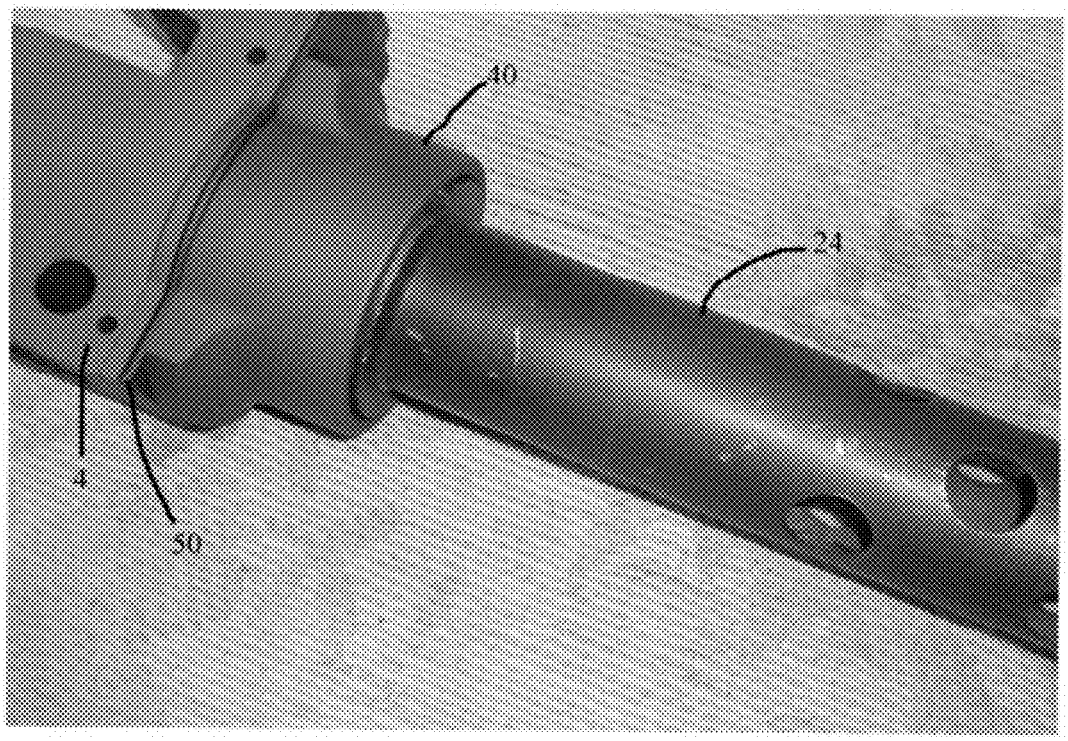
FIG. 10 is a perspective view of a trunnion nose guard in accordance with an embodiment of the present invention attached to a trunnion to which a small barrel support is also attached.

Preferred embodiments of trunnion nose guards according to the present invention are depicted in FIGS. 7A through 11B. Referring to FIGS. 7A-7C, there is shown front, side and rear perspective views of a trunnion nose guard 40. Referring now to FIG. 8, the trunnion nose guard 40 is shown in position to screw its internal threads 41 onto the outer threads 42 of the nose 18 of trunnion 4. The trunnion nose guard 40 includes a flange 44 having a face 46 that is adapted to fit against the front face 48 of the trunnion 4 or against a shim that is interposed between the trunnion front face 48 and the flange face 46, e.g., shim 50 that is shown in FIG. 10. The face 46 is designed so that its outer periphery does not axially extend beyond the periphery of the trunnion front face 48. This feature ensures that the trunnion nose guard 40 does not interfere with any support mechanisms of the machine gun. Preferably, the flange 44 has two wings 58A, 58B extending from opposite sides of the central portion 59 of the trunnion nose guard 40. These two wings 58A, 58B preferably are designed so that the outer periphery of the trunnion nose guard 40 approximates or matches the outer periphery of the trunnion 4 so that the trunnion nose guard 40.

The trunnion nose guard 40 has two receiving holes 52A, 52B for receiving a spring-biased locking pin 54 that extends through the trunnion front face 48. Preferably, the two receiving holes 52A, 52B are located as shown in FIG. 9 so that they are 180 degrees apart along an imaginary circle which intersects them both. Also preferably, each of receiving holes 52A, 52B is elongated on its flange face 46 side to accommodate some misplacement during manufacturing of a spring-biased locking pin 54 from its standard location on the trunnion front face 48. When the local flange thickness is greater than the projection distance of the spring-biased locking pin 54 from the trunnion front face 48, the side 56 of the hole opposite the flange face 46 may be smaller as its main purpose is to provide access to depress the spring-biased locking pin 54 as the trunnion nose guard 40 is screwed onto or off of the trunnion nose 18. The axial length of the trunnion nose guard 40 is selected so that, in use, the trunnion nose guard 40 protects all of the outer threads 42 of the trunnion nose 18, but does not extend substantially beyond the end of the trunnion nose 18. By restricting the axial length in this manner, the trunnion nose guard 40 does not interfere with access to the internal threads of the trunnion nose and also minimizes the weight of the trunnion nose guard 40.

The trunnion nose guard 40 may be made of any material deemed suitable for the purpose of protecting the trunnion nose outer threads 42 by a person skilled in the art, but preferably the trunnion nose guard is made of steel, most preferably 4130 or 4140 grade steel.

Referring now to FIG. 10, a trunnion nose guard 40 is shown attached to a trunnion 4. A shim 50 is located between the trunnion nose guard 40 and the trunnion 4 to cause a tight fit of the trunnion nose guard 40 at a thread-revolution attitude that permits the spring-biased locking pin 54 to lock into one of the receiving holes 52A, 52B (see FIG. 8). Also shown in FIG. 10 is a small barrel support 24 attached to the trunnion 4.

Figure 11:
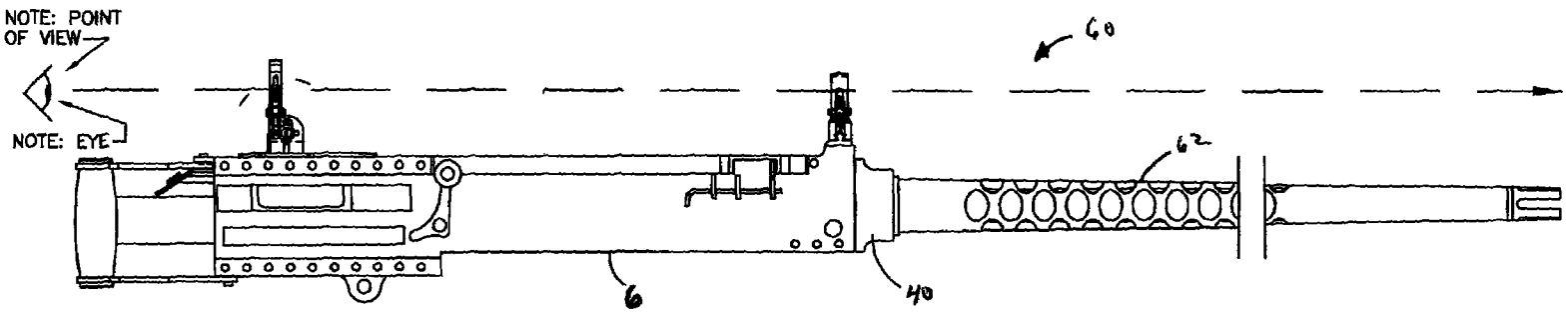
FIG. 11 shows a side view of a machine gun to which has been attached a trunnion nose guard in accordance with an embodiment of the present invention.

Referring now to FIG. 11, there is shown a side view of a trunnion nose guard 40 attached to the trunnion 4 of a machine gun 60. The machine gun 60 shown in this figure also has a large diameter heavy barrel support 62 attached to the trunnion 4.

While only a few embodiments of the present invention have been shown and described, all modifications and changes that may be made thereunto by a person of ordinary skill in the art are to be considered as being within this disclosure. All documents referenced herein are incorporated by reference to the maximum extent permitted.

What is claimed is:

1. A trunnion nose guard for protecting outer threads of a cylindrical nose of a trunnion of a Browning .50 caliber machine gun, the trunnion having a front face from which the nose axially extends, the front face having an outer periphery, and a spring-biased locking pin extending from the front face, the guard comprising a hollow cylinder having first and second ends, the first end having a flange having a flange face adapted to fit against the front face of the trunnion, an outer periphery which does not radially extend beyond the outer periphery of the front face of the trunnion, and a through-hole for releasably receiving the spring biased locking pin, the second end of the cylinder having internal threads adapted to cooperate with the trunnion nose outer threads to permit the guard to be threadably attached to the trunnion, and an axial length selected so that when the guard is threadably attached to the trunnion and the spring-biased locking pin is received within the hole of the guard flange, the second end does not extend substantially beyond the end of the trunnion nose.

2. The trunnion nose guard of claim 1, wherein the hole is elongated on the flange face side of the hole.

3. The trunnion nose guard of claim 1, wherein the flange has two holes located 180 degrees apart for receiving a spring-biased locking pin located on the trunnion front face.

4. The trunnion nose guard of claim 3, wherein each hole is elongated on the flange face side of the hole.

5. The trunnion nose guard of claim 1, wherein the guard comprises steel.

6. The trunnion nose guard of claim 1, wherein the machine gun is a Browning model that is selected from the group consisting of models M2HB, M3HB, M3HB flexible, M3, and M3M.

* * * * *